US008096719B1

(12) United States Patent
Bailey et al.

(10) Patent No.: US 8,096,719 B1
(45) Date of Patent: Jan. 17, 2012

(54) CONTINUOUS PERSONALIZED PLASTIC CARD MANUFACTURING SYSTEM

(75) Inventors: Mark H. Bailey, Trophy Club, TX (US); John C. Searfoss, Colleyville, TX (US); Frank Artinger, Jr., Frisco, TX (US); Jason Artinger, Frisco, TX (US)

(73) Assignee: Plastic Cards, LLC, Dallas, TX (US)

( * ) Notice: Subject to any disclaimer, the term of this patent is extended or adjusted under 35 U.S.C. 154(b) by 423 days.

(21) Appl. No.: 12/427,251

(22) Filed: Apr. 21, 2009

(51) Int. Cl.
*B41J 11/00* (2006.01)

(52) U.S. Cl. ..... 400/621

(58) Field of Classification Search ..... 235/492; 400/621; 428/43; 283/61
See application file for complete search history.

(56) References Cited

U.S. PATENT DOCUMENTS

| | | | | |
|---|---|---|---|---|
| 6,186,398 | B1 | 2/2001 | Kato et al. | |
| 6,688,529 | B1 | 2/2004 | Goade, Sr. | |
| 6,964,810 | B2 * | 11/2005 | McCannel et al. | 428/323 |
| 7,059,534 | B2 * | 6/2006 | Takahashi | 235/492 |
| 7,326,315 | B2 | 2/2008 | Behnen | |
| 7,514,134 | B2 * | 4/2009 | Utz et al. | 428/43 |
| 2005/0147781 | A1 * | 7/2005 | Dronzek et al. | 428/40.1 |
| 2007/0035121 | A1 | 2/2007 | Behnen | |
| 2007/0289460 | A1 | 12/2007 | Tang | |
| 2008/0305365 | A1 | 12/2008 | Yamazaki et al. | |

FOREIGN PATENT DOCUMENTS

| | | |
|---|---|---|
| EP | 1115106 A1 | 7/2001 |
| JP | 08329457 | 12/1996 |
| JP | 09204661 | 8/1997 |
| JP | 2000255179 | 9/2000 |

* cited by examiner

*Primary Examiner* — Seung Lee
(74) *Attorney, Agent, or Firm* — Luedeka, Neely & Graham, P.C.

(57) ABSTRACT

A method for producing personalized cards on a substantially continuous basis. The method includes providing multiple supply rolls of card stock having a thickness of at least about 12 mils. The card stock is corona treated in an in-line corona treating unit to provide a printable surface having a surface tension energy of at least about 38 dynes/cm. Fixed and variable data are printed on individual card units of the card stock in first and second printing units of the in-line printing system. A removable activation label may be applied by an in-line label application unit to the variable data. The card units are die cut in an in-line die-cutting unit to a predetermined size. The first and second printing units are shaft driven printing units and the card units are capable of producing card units at a rate of at least 50,000 card units per hour.

14 Claims, 4 Drawing Sheets

CONTINUOUS PERSONALIZED PLASTIC CARD MANUFACTURING SYSTEM

TECHNICAL FIELD

The disclosure relates a continuous process system for manufacturing personalized plastic cards containing variable consumer information.

BACKGROUND AND SUMMARY

Conventionally, thick plastic cards, such as gift cards, prepaid telephone cards, discount cards, transaction cards, and the like, are manufactured using methods having a series of steps. These steps ordinarily include initially printing text and graphics on a card, laying magnetic tape on the card, separating the card from its substrate, encoding the magnetic tape with information, and finally printing variable information on the card, such as a secret personal identification number (PIN), as well as covering the PIN with a scratch-off foil material.

To accomplish these steps, typically flat sheets of card stock are processed though multiple separate machines. Such flat sheets can only be made into a relatively small number of cards per sheet (ordinarily between 25 and 50) and must be moved by a human operator between separate machines throughout the printing process.

Some cards require the application of variable information to the card. Typically, variable information is added to the cards after the cards are separated from sheet stock material. As such, once the cards from an individual sheet or group of sheets are separated and collected, the cards are taken to a processing station for applying variable information to the cards. One processing station may encode variable information to a portion of the individual cards. Another processing station may apply variable printing to the individual cards. The cards may then be sent to a labeling/foiling station to produce a finished product which may be shingled onto a conveyor to be collected and packaged in an orderly fashion.

All of these steps, multiple separate machines, and human interventions make processing thick plastic card stock currently very time consuming and expensive. However, because customers prefer relatively thick plastic cards as a source of value (as opposed to paper cards or very thin plastic cards), the multi-step, multi-machine, and human intervention manufacturing process is widely used today. As the demand for relatively thick cards increases, there is a need for a substantially continuous process for producing personalized cards on card stock material having a thickness of at least about 12 mils.

In view of the foregoing need, one aspect of the disclosed embodiments provides a method for producing personalized cards on a substantially continuous basis. The method includes providing multiple supply rolls of card stock having a thickness of at least about 12 mils to an in-line printing system. The card stock is corona treated in an in-line corona treating unit to provide a printable surface having a surface tension energy of at least about 38 dynes/cm. Fixed data is printed on individual card units of the card stock in a first printing unit of the in-line printing system. Variable data is printed on the card units of the cards stock in a second printing unit of the in-line printing system. Optionally, a removable activation label is applied by an in-line label application unit to the variable data printed on the card units. The card units are die cut in an in-line die-cutting unit to a predetermined size. The first and second printing units are shaft driven printing units and the card units are capable of being produced at a rate of at least 50,000 card units per hour.

An advantage of the process described herein is that multiple processing steps, normally requiring remotely separate processing units may be combined in in-line processing units to provide relatively thick personalized cards. The personalized cards may be produced at rates that cannot be achieved by separate processing units providing the same processing steps.

BRIEF DESCRIPTION OF THE DRAWINGS

The accompanying drawings, together with the specification, illustrate exemplary embodiments of the present invention, and, together with the description, serve to explain the principles of the present invention.

Figure 1:
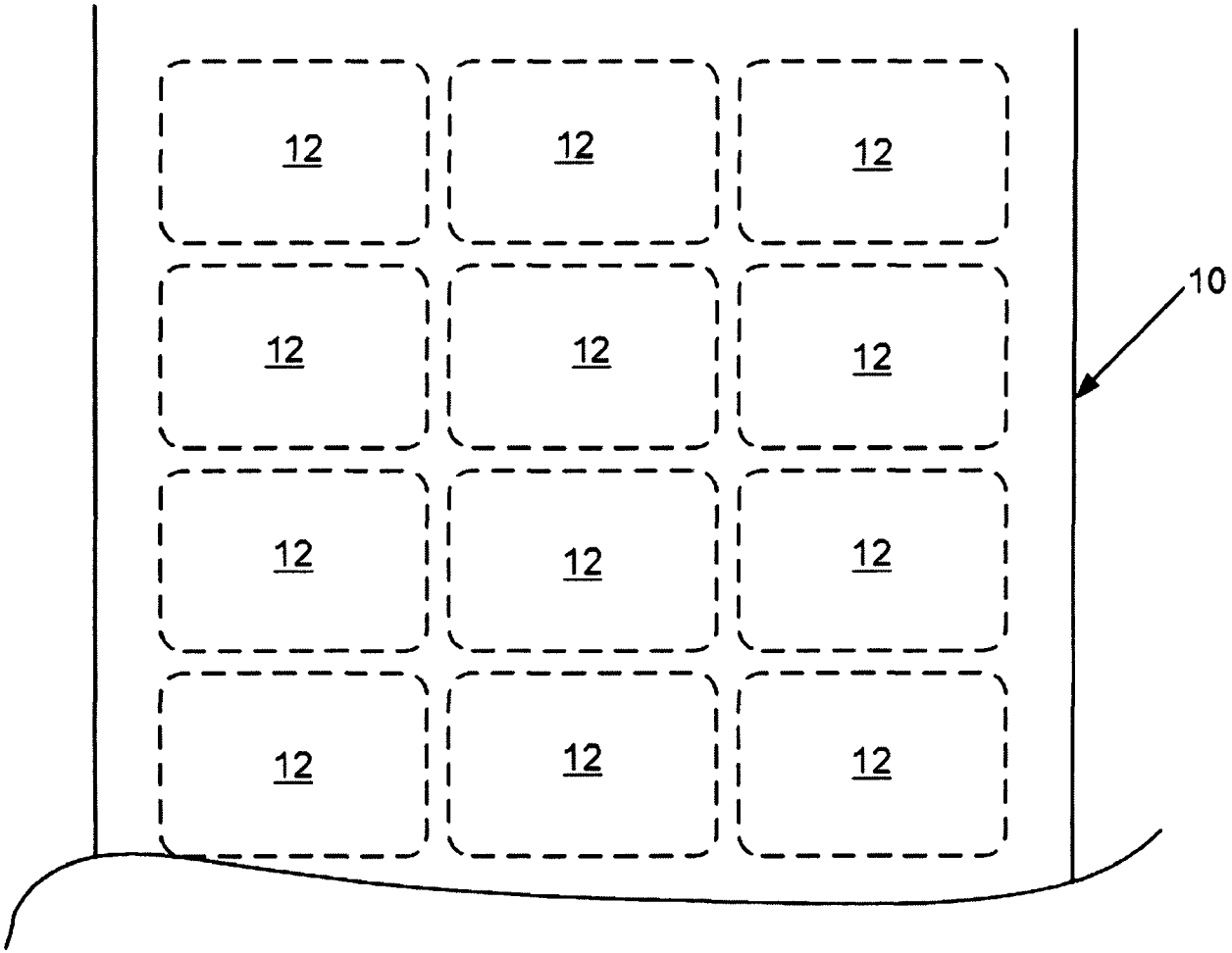
FIG. 1 is a plan view, not to scale, of a continuous web of card stock for producing personalized cards according to an embodiment of the disclosure.

Before any embodiment of the invention is explained in detail, it is to be understood that the disclosed embodiments are not limited in their application to the details of construction and arrangements of components set forth in the following description, or illustrated in the drawings. The disclosed process is capable of alternative embodiments and of being practiced or being carried out in various ways. For example, paper stock could be used in place of plastic stock with the apparatus as described herein. Also, it is to be understood that the terminology used herein is for the purpose of illustrative description and should not be regarded as limiting.

DETAILED DESCRIPTION

In the following detailed description, certain exemplary embodiments of the disclosed process are shown and described by way of illustration. As those skilled in the art would recognize, the described exemplary embodiments may be modified in various ways, all without departing from the spirit or scope of the appended claims. Accordingly, the drawings and description are to be regarded as illustrative in nature, rather than restrictive. There may be parts shown in the drawings, or parts not shown in the drawings, that are not discussed in the specification as they are not essential to a complete understanding of what is being claimed. In the drawings, like reference numerals are intended to designate like elements throughout.

With reference to FIG. 1, there is shown in plan view, not to scale, a substantially continuous web 10 of card stock material that may be used to produce card units 12 according to an embodiment of the disclosure. The card stock material, providing the web 10 may be selected from paperboard or plastic web materials having a thickness of at least about 12 mils. In order to provide more durable card units 12, the card stock web 10 may have a thickness ranging from about 20 to about 30 mils. Above about 30 mils, the card stock web 10 may become more difficult to handle in web form. Below about 12 mils, the card stock web 10 may be too flimsy to provide durable card units 12.

The plastic materials that may be suitable for providing the card stock web 10 may include, but are not limited to, polyvinyl chloride (PVC), low density polyethylene (LDPE), high density polyethylene (HDPE), polyethylene terephthalate, polybutylene terephthalate, polypropylene, ethylene vinyl acetate, polycarbonate, polystyrene, and combinations of two or more of the foregoing. Paperboard card stock for providing the web 10 may be coated or uncoated card stock, or may be a combination of a paperboard core and a plastic surface.

Figure 2B:
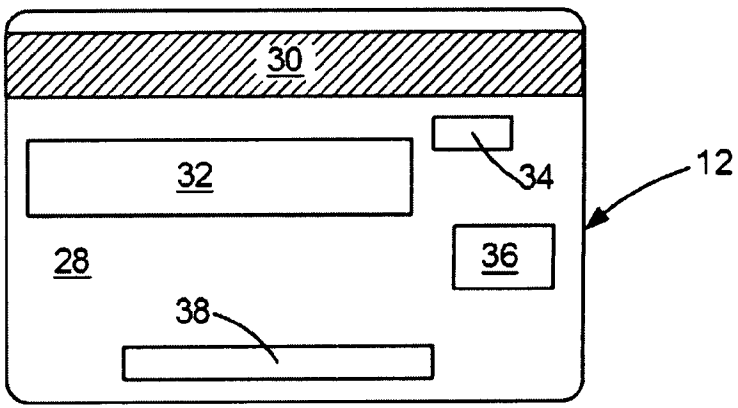
FIG. 2B is a plan view, not to scale, of a second side of a card made according to the disclosed process.
Figure 2A:
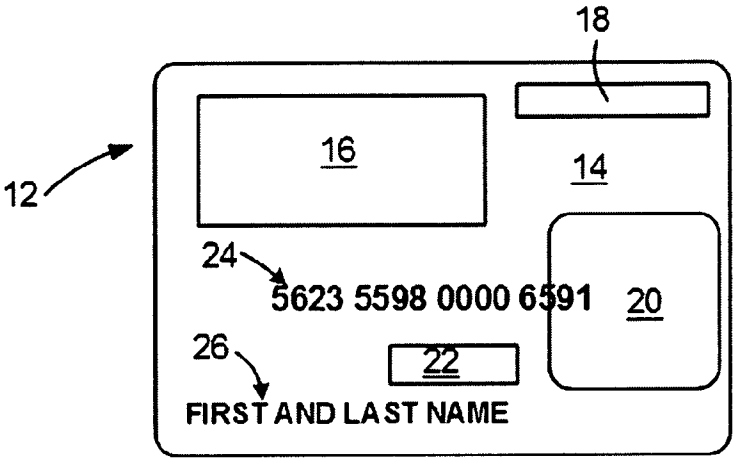
FIG. 2A is a plan view, not to scale, of a first side of a card made according to the disclosed process.

FIG. 2A is an illustration of a first surface 14 of one of the card units 12 made from the web 10 according to the disclosed process. The first surface 14 may include an image area 16 containing a vendor image, a vendor identification area 18 containing a vendor code, a decorative logo area 20 containing a vendor logo, a date area 22 for an expiration date of the card, a unique card number 24, and a name area 26 for a unique user name. It will be appreciated that areas 16, 18, and 20 may be fixed image areas that are applied to all of the card units 12 of a batch of card units 12. Likewise, areas 22, 24 and 26 may represent variable image areas that are unique to an individual card unit 12.

One or more of the image area 16, vendor identification area 18, date area 22, card number 24, and name area 26 may be embossed in order to upgrade the appearance of the card units 12. Likewise, a decorative film or holographic image may be applied in area 20 to provide easy authentication of the card units 12.

An opposing surface 28 of the card unit 12 is illustrated in FIG. 2B. The opposing surface 28 of the card unit 12 may include an encodable magnetic strip 30, a signature block area 32 for signing by a user, a signature code area 34 containing a unique signature code, an optional logo area 36, and a removable label 38 covering unique card activation information. It will be appreciated that only the signature block area 32 and optional logo area 36 may be fixed areas while the signature code area 34 and area under the removable label 38 may be variable image areas that are unique to an individual card unit 12. The signature block area 32 may be an area that is coated or printed with an ink receptive coating in order to retain a signature of a user of the card unit 12. The magnetic strip area 30 may be provided by a magnetic film that is adhesively applied or laminated to the area 30 of the card unit 12 to provide a machine readable card unit 12. In the alternative, a variable bar code image may be applied in area 30 to provide a machine readable card unit 12.

In some embodiments, after printing fixed and variable images on the card units 12, the card units 12 may be laminated with films that provide for increased durability of the imaged areas. In an alternative embodiment, a clear hot stamping foil may be applied to select areas of the card units 12 to increase the durability of only certain areas of the card units 12.

Figure 3:
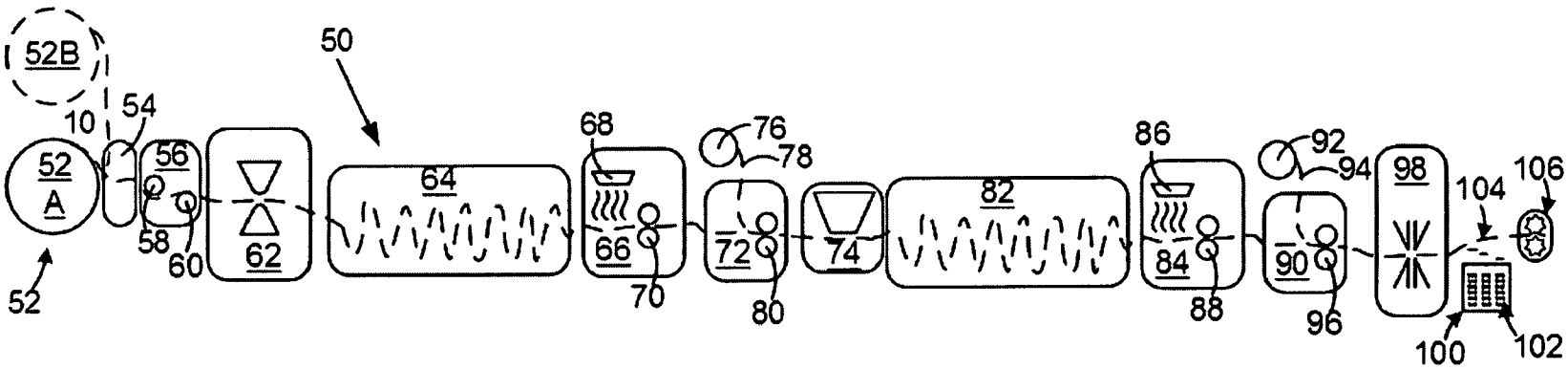
FIG. 3 is a schematic flow diagram of an in-line process for producing cards according to the disclosure.

With reference now to FIG. 3, there is shown an in-line printing system 50 according to an exemplary embodiment of the disclosure. The printing system 50 features units that are arranged in a single process line that provides multiple operations for producing the card units 12 described above with reference to FIGS. 2A and 2B from the web 10 of card stock material. The system 50 is designed to produce personalized cards on a substantially continuous basis from relatively thick card stock material. In various embodiments, the system shown in FIG. 3 may receive card stock having a thickness of at least 2 mils. In other embodiments, the stock material may have a thickness ranging from about 20 to about 30 mil.

In order to maintain substantially continuous operation of the system 50, a dual roll system 52 and in-line splicing unit 54 is used for providing the web 10 to the units of the system. The dual roll system 52 and splicing unit 54 may include rolls 52A and 52B that are spliced end to end using an adhesive tape system and an air loaded nip roller. The dual roll system 52 may be driven by a servo drive motor that is synchronized with a shaft drive unit for the system 50. Dancer rolls may be used to provide constant tension on the web 10 as the web unrolls from the rolls 52A and 52B.

When a web of plastic card stock is provided on a roll, such as rolls 52A and 52B, the web 10 may tend to form a set curvature over time. As such, when the card stock is unrolled and passed over the rollers of a printing line, it only partially elastically deforms while retaining internal stresses inducing it to deviate from the path formed by these rollers. The curvature of the web 10 may cause problems in the processing of the card stock in the subsequent units of the system 50.

In order to remove any curl from the web 10, a planarizing unit 56 is provided after the dual roll system 52 to provide feed of a substantially planar web to the other units of the system 50. The planarizing unit 56 may be included in the system 50 and in an exemplary embodiment may be placed in position between the rolls 52 and a first print unit 64 of the system 50. The planarizing unit 58 may be provided with heated rollers 58 and 60 or heat lamps to heat the web 10 as it passes through the unit 56. As is known to one skilled in the art, the heated rollers 58 and 60 may be used to remove internal stresses of the web allowing it to de-cure and plastically, rather than elastically, deform to more easily assume the shape imposed by the rollers and supports of the system 50. Offset rollers may be used in the planarizing unit 56 to remove the web 10 from the heated rollers 58 and 60 when the system 50 is idle in order to prevent overheating of the web 10.

In order to increase adhesion of the printed images to the web 10, particularly in the case of plastic card stock, a corona treating unit 62 is suitably used before the first print unit 64. The corona treating unit 62 may be used to treat one or both surfaces of the web 10 so as to increase a surface tension energy of the web surfaces to at least about 38 dynes/cm. Depending on the material used for the web 10 and the type of ink or coating to be applied to the web 10, the surface tension energy of the web 10 may be increased to a range of from about 38 to about 60 dynes/cm. A suitable surface tension energy for most printing applications may range from about 38 to about 46 dynes/cm.

The first printing unit is a shaft driven printing unit 64 that may apply up to about seven colors to the web 10 to provide decorative or informational images on the card units 12 as described above. Accordingly, the first printing unit 64 may include up to seven flexographic print rolls for applying different colors to the web 10. Typically, the first printing unit 64 will apply the non-variable data or images to the web 10 to provide the card units 12. The first printing unit 64 may include one or more forward print stations to print on a first surface 14 of the web 10. The forward print stations may include print cylinders or anilox rollers.

After the forward print stations, a spacer module (or spacer unit assembly) may be included placed to enable reverse printing on the web 10. The spacer module may be followed by one or more reverse print stations as required to provide the non-variable images on the second surface 28 of the card units 12. The reverse print stations may incorporate print cylinders and may be fitted with a reverse angle doctor blade ink pan. In one embodiment, the reverse print stations may be fitted with a fully enclosed doctor blade as well as an ink pump for reverse printing.

An advantage of using shaft driven printing units, such as the first printing unit 64, as opposed to using digital servo drives with feedback control is that print registration may be set and maintained independently from the shaft drives of the printing units. Without proper registration, the web 10 of card stock may be advanced or delayed along the printing line. Such advances or delays in movement of the web are especially problematic for multi-pass printing applications including four-color printing, because a portion of the card stock which is improperly advanced or delayed along the printing line may receive a portion of its graphic image too early or too late, causing misalignment with graphics printed at other stations along the line.

In order to properly register the card units 12 on the web 10 with the first printing unit 64, a digital servo driven registration motor connected to a web drive roll is used to advance the web 10 to the first printing unit 64. The shaft speed of the first printing unit 64 provides feedback to the servo driven registration motor in order to maintain a web speed that provides a constant web tension to the printing unit 64 so that registration is maintained throughout the system 50.

Subsequent to the first printing unit 64, or between one or more of the print stations of the printing unit, a drying unit 66 may be included to cure the ink or coating on the web 10. The drying unit 66 may include a drying oven 68, heat lamp, ultraviolet lamp, hot air, or other drying mechanism to remove moisture of solvents from the printed or coated image on the web 10. Although a drying oven 68 is illustrated in FIG. 3, it will be understood that in alternative embodiments, inks or coatings printed or applied to the web 10 by the forward and reverse printing stations may be dried and/or cured using any combination of the following methods: infrared, re-circulating air and hot air, and/or UV with or without chilled rollers. As shown in FIG. 3, a chilled roll 70 may be used subsequent to the drying unit 66 in order to cool the web 10 for further processing.

Because the system as described herein allows a web of rolled card stock to be used, it is no longer necessary to provide separate remote units to perform each step of card manufacture. As cards become more competitive, it becomes increasingly important to provide card units 12 that contain more than only printed images. Various decorative or functional improvements to the card units 12 may include magnetic tape application and encoding, decorative embossing, variable printing, decorative foil application, removable label application, and card die cutting and separation, which were all formerly performed separately on individual sheets or card stock, may now be performed on the same in-line system 50 on different portions of the card units 12 as the web advances through the system 50. To this end, processing units have been added to the system 50 past the minimum required units for simple printing and imaging of the web 10.

In one embodiment, the system 50 includes a magnetic tape application unit 72 and tape encoding unit 74. The magnetic tape application unit 72 includes a supply roll 76 of magnetic media 78 that may be applied to a select portion of the web 10 provide the card units 12 as shown in FIG. 2B.

In one embodiment, a premanufactured strip of low or high coercivity magnetic media 78 is unwound from the supply roll 76 and is applied to the surface 28 of the card units 12. The strip 30 of magnetic media 78 has an adhesive backing that may be fixed to the card units 12 by a conventional hot stamp unit or by nip rollers 80. One, two or three tracks of encoded data may be written on the strip 30 via the magnetic write/read encoding unit 74. The data on the magnetic strip 30 may be read for verification by the magnetic write/read head.

In one embodiment, the in-line magnetic card encoding performed in the magnetic write/read encoding unit 74 may be supported by a magnetic controller board, which supports single track encoding along the strip 30. Thus, the insertion of additional magnetic write/read encoding assemblies (or magnetic controller boards) allows simultaneous encoding of two (2) or three (3) tracks of card data along the strip 30. Furthermore, the magnetic controller board supports high and low coercivity magnetic media encoding by adding or removing a high current driver module and booster power supply.

As shown in FIG. 3, the system 50 may include a second printing unit 82 for providing variable data and/or images to the card units 12 on the web 10. The second printing unit may print personalized information and/or variable information or data (e.g., variable pin numbers, barcodes, serial numbers, instructions, advertisements, etc.) using the variable printing unit 82. In one embodiment, the variable printing unit 82 may be a digital variable printing unit that can be remotely controlled by a variable print encoding computer. Also, in one embodiment, the variable printing unit 82 may be a variable printing and foil applicator device adapted to print variable data, such as a secret PIN number, as well as to cover the variable data (e.g., the PIN number) with a scratch-off foil material.

As with the first printing unit, the second printing unit 82 is a shaft driven printing unit 82 that may also apply up to about seven colors to the web 10 to provide decorative or informational images on the card units 12 as described above. Hence, the second printing unit 82 may also include up to seven flexographic print rolls for applying different colors to the web 10. Like the first printing unit 64, the second printing unit 82 may also include one or more forward print stations to print on a first surface 14 of the web 10 and a spacer module (or spacer unit assembly) to enable reverse printing on the web 10. The spacer module may be followed by one or more reverse print stations as required to provide the variable images on the surface 28 of the card units 12.

As with the first printing unit 64 a second drying unit 84 may follow the second printing unit 82 to cure the ink or coating on the web 10. As described above, the second drying unit 84 may include a drying oven 86, heat lamp, ultraviolet lamp, hot air, or other drying mechanism to remove moisture of solvents from the printed or coated image on the web 10. Also, a second chilled roll 88 may be used subsequent to the second drying unit 86 in order to cool the web 10 for further processing.

Another component of the in-line system 50 may be an activation label unit 90. The activation label unit 90 may be included in the system after the variable printing unit 82 or after the non-variable printing unit 64. A roll 92 of activation label stock 94 may be used to hide variable or non-variable information printed on the card units 12 and like the magnetic strip 78 may be adhesively applied to a particular area of the card units 12. Prior to use by a consumer, the activation label may be removed from the card to reveal information such as a personal identification number, telephone number, password, or other information that is used to activate or access the card. In the case of an adhesively applied activation label, a nip roller 96 or other heated or non-heated pressure application device may be used to adhesively fix the label to the card unit 12.

Other units may be included in the system 50, such as an embossing unit, a scratch off foil application unit, a film lamination unit and the like. After completing the printing and application of coatings, and films to the card units 12, the card units 12 are die cut from the web 10 in a die cutting unit 98. The die cut card units 12 may be separated from the web 10 subsequent to the die cutting unit 98 and packaged by a packaging unit 100 in packing sleeves 102. The remaining portion 104 of the web 10 may be ground in a grinding unit 106 for recycle or disposal purposes.

Figure 4:
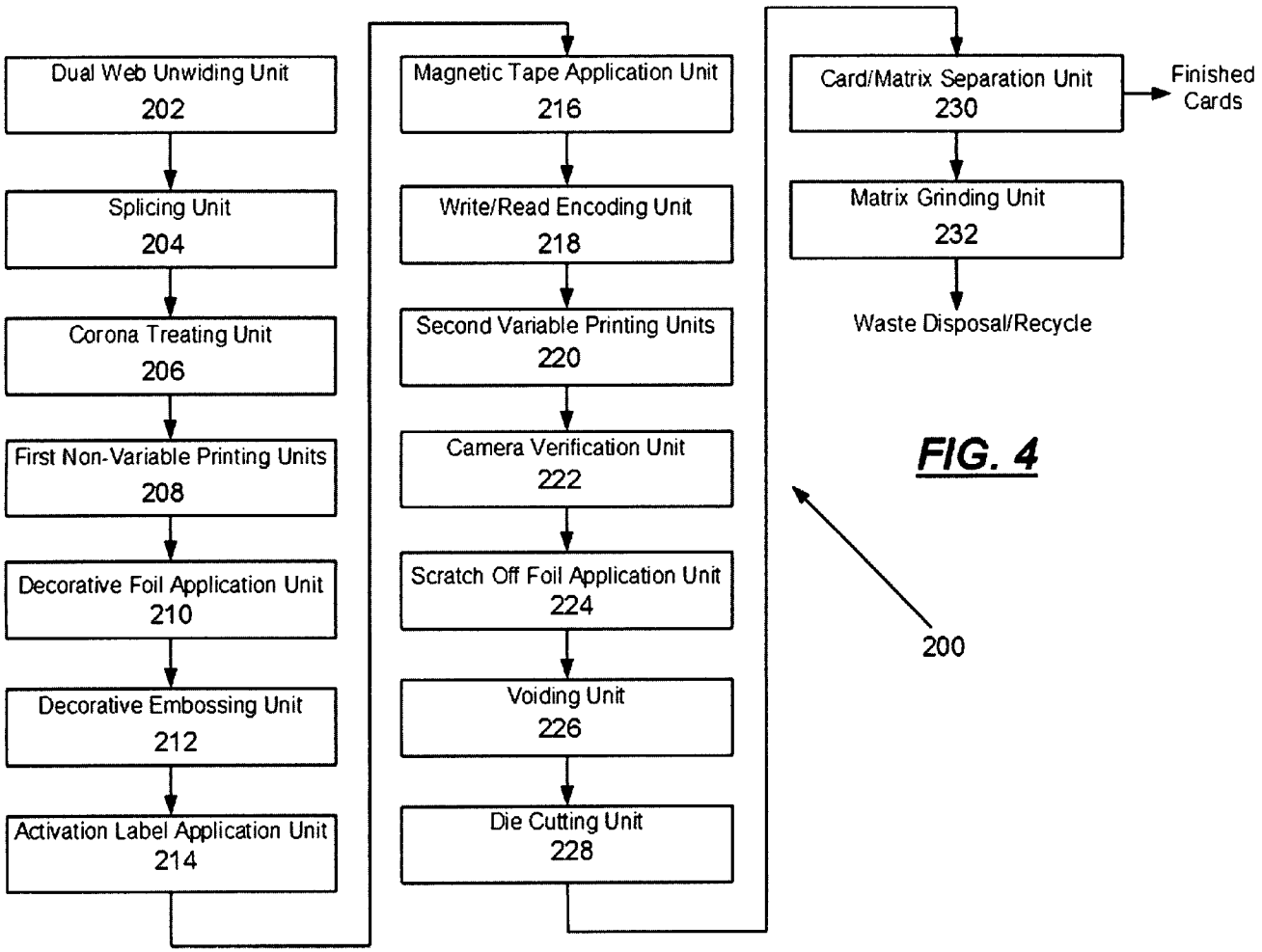
FIG. 4 is a flow diagram of an in-line process for producing cards according to an alternate embodiment of the disclosure.

It will be evident from the foregoing description that a wide variety and arrangement of units may be included in the in-line system 50 according to the disclosure provided the units are primarily shaft driven to provide movement of a registered web through the system 50 with a minimum variance from one end of the system 50 to the other end of the system. Accordingly, in an alternate embodiment, an arrangement of units in a system 200 may used as illustrated in FIG. 4. As with the system 50 described above, the system 200 include a dual web unwinding unit 202 and a splicing unit 204 to provide a substantially continuous web 10 to the system 200. Prior to a first non-variable printing unit 208, a corona treating unit 206 may be used to provide an increased surface tension energy for the web 10 so that the web is more compatible with subsequently printed images and coatings applied to the web 10.

The system 200 also may include a decorative foil application unit 210 for applying colored or decorative foils to the card units 12. A decorative embossing unit 212 may be used to provided raised lettering or images on the card units 12. For security purposes, an activation label may be applied to the card units 12 using an activation label application unit 214.

In a magnetic tape application unit 216, a magnetic tape as describe above may be applied to the card units 12. If applied to the card units, a read/write encoding unit 218 is used to encode the magnetic tape and to verify the information that has been encoded on the tape.

A second variable printing unit 220 is used in the system 200 to apply variable data or images to the card units 12. In order to determine if the card units are properly printed, a camera verification unit 222 may be used to verify the information printed on the cards and to provide information to a voiding unit 226 that applies a message to card units that are defective. A scratch off foil application untie 224 may be used after the second printing units 220 to provide a scratch off material to the card units. All of the card units, whether acceptable or voided are die cut from the web 10 in a die cutting unit 228. The die cut card units are separated from a remaining web matrix in a card/matrix separation unit 230. The finished, non-voided card units are packaged in sleeves for shipping. The web matrix remaining after removing the card units is ground in a matrix grinding unit 232 for disposal and/or recycle.

Accordingly, with such a system, large rolls of thick plastic substrate rather than smaller flat sheets of card stock may be processed rapidly and quickly in an in-line integrated system. Production rates for the card units 12 may exceed 50,000 card units per hour on a substantially continuous basis. Depending on the complexity of the images and other features applied to the card units 12, production of card units may exceed 100,000 card units per hour. Ideally, production rates of 125,000 to 150,000 card units per hour may be achieved with the systems 50 and 200 described herein thereby providing a more economical production of card units 12 than is possible with conventional sheet fed systems.

While the disclosure has provided certain exemplary embodiments, it is to be understood by those skilled in the art that the exemplary embodiments are not limited to what is disclosed herein, but, on the contrary, is intended to cover various modifications included within the spirit and scope of the appended claims and equivalents thereof.

What is claimed is:

1. A method for producing personalized cards on a continuous basis comprising:

providing multiple supply rolls of card stock having a thickness of at least about 12 mils to an in-line printing system;

corona treating the card stock in an in-line corona treating unit to provide a printable surface having a surface tension energy of at least about 38 dynes/cm;

printing fixed data on individual card units of the card stock in a first printing unit of the in-line printing system;

printing variable data on the card units of the cards stock in a second printing unit of the in-line printing system;

applying a removable activation label to the variable data printed on the card units by an in-line label application unit; and die-cutting the card units in an in-line die-cutting unit to a predetermined size, wherein the first and second printing units are shaft driven printing units, and the card units are capable of being produced at a rate of at least 50,000 card units per hour.

2. The method of claim 1, further comprising packing card units from the die-cutting unit in packing sleeves.

3. The method of claim 1, further comprising embossing the card units on an in-line embossing unit.

4. The method of claim 1, further comprising applying a magnetic strip to the card units in an in-line magnetic strip unit.

5. The method of claim 4, further comprising encoding the magnetic strip in an in-line encoding unit.

6. The method of claim 1, further comprising laminating a film to the card units in an in-line lamination unit.

7. The method of claim 1, wherein at least 75,000 card units per hour are produced on a continuous basis.

8. The method of claim 1, wherein at least 100,000 card units per hour are produced on a continuous basis.

9. The method of claim 1, wherein at least 125,000 card units per hour are produced on a continuous basis.

10. The method of claim 1, wherein at least 150,000 card units per hour are produced on a continuous basis.

11. The method of claim 1, further comprising curing the fixed data and variable data in first and second curing units subsequent to the first and second in-line printing units.

12. The method of claim 1, further comprising applying a decorative foil layer to the card units in an in-line foil application unit.

13. The method of claim 1, further comprising heating the card stock from the supply rolls in a planarizing unit prior to the first printing unit to provide a planar web for printing.

14. The method of claim 1, wherein the card stock has a thickness ranging from about 20 to about 30 mils.

* * * * *

UNITED STATES PATENT AND TRADEMARK OFFICE

CERTIFICATE OF CORRECTION

PATENT NO. : 8,096,719 B1
APPLICATION NO. : 12/427251
DATED : January 17, 2012
INVENTOR(S) : Mark H. Bailey et al.

It is certified that error appears in the above-identified patent and that said Letters Patent is hereby corrected as shown below:

On the cover page, item (73), please change the Assignee from "Plastic Cards, LLC" to:

-- I3 Plastic Cards, LLC --

Signed and Sealed this
Twenty-first Day of August, 2012

David J. Kappos

David J. Kappos
*Director of the United States Patent and Trademark Office*